United States Patent [19]

Gorell

[11] 4,244,269

[45] Jan. 13, 1981

[54] PRONG-TYPE FASTENER

[75] Inventor: Frederick R. Gorell, Streator, Ill.

[73] Assignee: Transco, Inc., Chicago, Ill.

[21] Appl. No.: 955,583

[22] Filed: Oct. 30, 1978

[51] Int. Cl.[3] ..... F16B 17/00; E04B 1/40; A44B 21/00

[52] U.S. Cl. ..... 411/477; 24/73 B; 52/506

[58] Field of Search ..... 85/11, 5 R, 36, 8.8; 24/73 B, 73 SC, 73 FT, 259 TF, 216, 217 R, 213 B; 52/506, 361

[56] References Cited

U.S. PATENT DOCUMENTS

| | | | |
|---|---|---|---|
| 1,248,047 | 11/1917 | Woolley | 85/11 UX |
| 1,690,853 | 11/1928 | Behrman | 24/216 X |
| 2,697,857 | 12/1954 | Eckel | 85/11 X |
| 3,511,127 | 5/1970 | Gisondi | 85/11 |
| 3,798,710 | 3/1974 | Tinnerman | 85/36 X |
| 4,111,096 | 9/1978 | Fasth | 85/11 |

*Primary Examiner*—Ramon S. Britts
*Attorney, Agent, or Firm*—Edward C. Threedy

[57] ABSTRACT

A fastener for attaching a panel of insulating material to the inner surface of a metallic wall structure. The fastener consists of a prong-type member having one end mounted onto the inner wall surface of the wall structure and adapted to have its opposite free end penetrated through a panel of insulating material with such free end cooperating with a locking plate positioned exteriorly of the panel of insulating material for securing the same onto the wall structure.

1 Claim, 3 Drawing Figures

PRONG-TYPE FASTENER

SUMMARY OF THE INVENTION

A principal object of this invention is the provision in a fastener of this character for attaching panels of insulating material of varying thicknesses to the inner wall surface of a metallic structure.

A further object of the invention is to provide a fastener wherein the panel of insulating material is adapted to be impinged upon the prong-type member of the fastener and held in a compressed condition between the inner wall surface of the structural member and a locking plate cooperating with the prong for assembling the panel of insulating material to the support structure.

By the use of this invention an insulated wall panel may be prefabricated prior to full erection into a structure or the insulating panel may be added to the inner wall surface of an existing wall structure.

GENERAL DESCRIPTION

Figure 1:
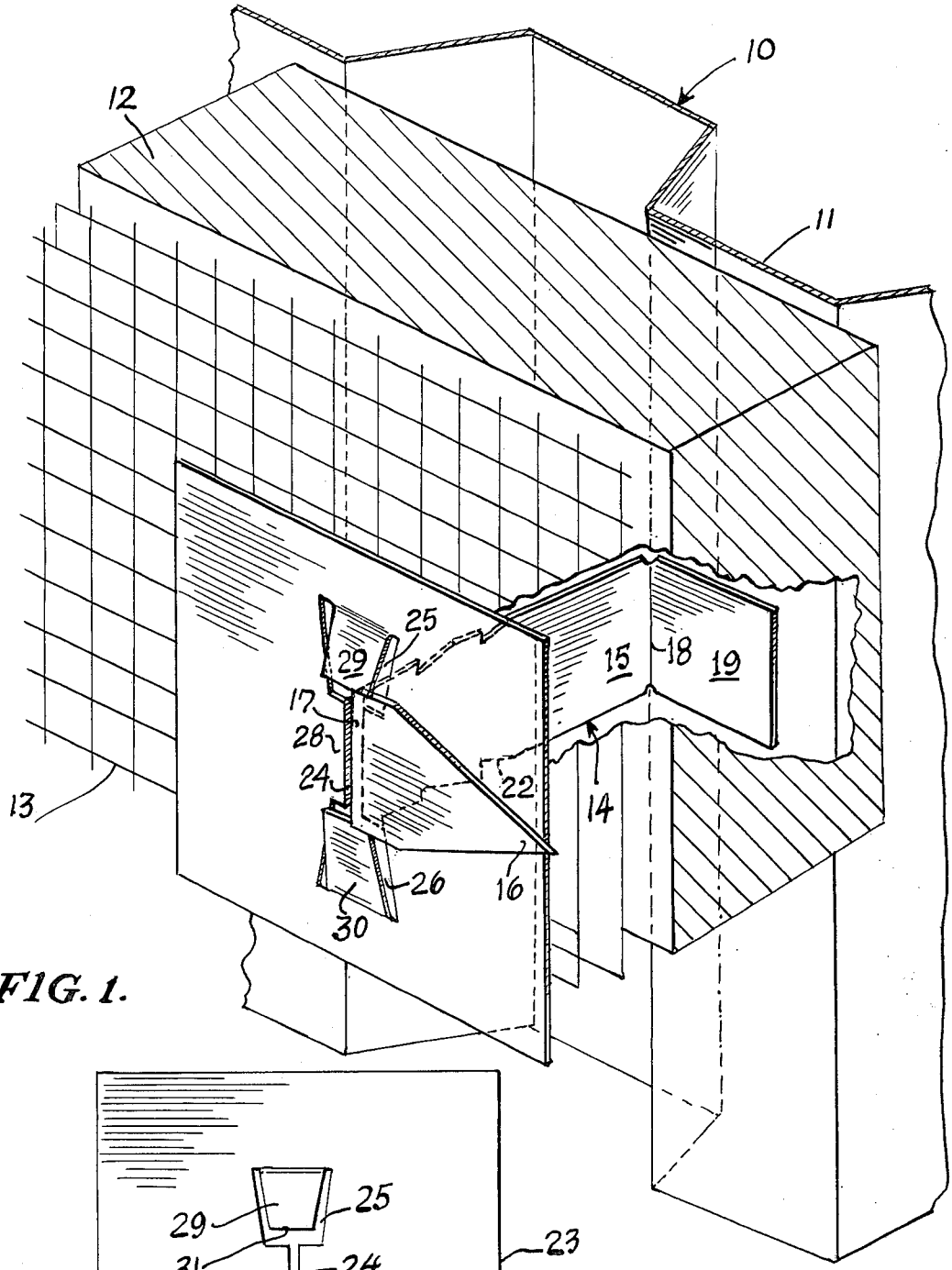

The invention will be best understood by reference to the accompanying drawing showing the preferred form of construction by which the stated objects are achieved and in which FIG. 1 is a perspective view of the improved prong-type fastener in an operative condition.

Figure 2:
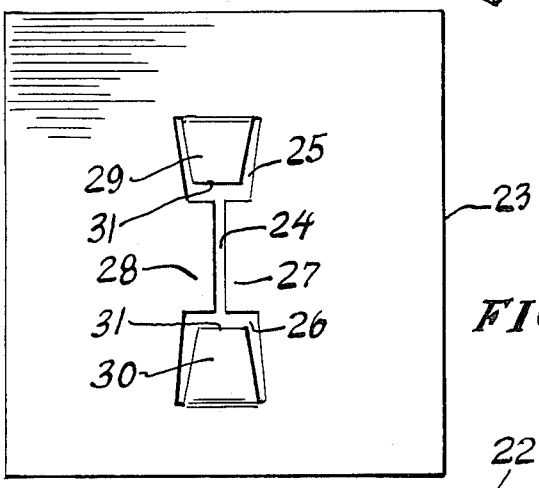
Figure 3:
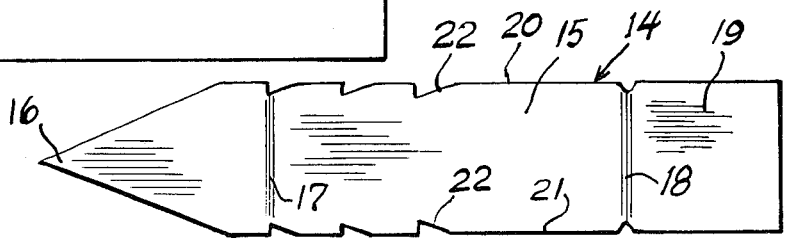

FIG. 2 is a plan view of the locking plate associated with the prong-type fastener of this invention, and FIG. 3 is a side elevational view of the prong member in an unassembled condition.

This invention is adapted to be normally used in the construction of an insulated wall structure. As shown in FIG. 1, the wall structure normally comprises a metallic wall member 10 which as shown is in a corrugated form. Adapted to be mounted on the bight portion 11 of the corrugated metallic wall 10 is a batt of insulating material 12. This insulating material may be in the form of fiberglass and the like and as such may be slightly compressed and bonded together by a suitable resin or the like.

Mounted upon the exposed face of the batt of insulating material 12 may be a wire mesh screening 13 for the purpose of maintaining the batt of material in a compressed or bonded condition, it being a known fact that any substantial break in the batt of insulating material 12 creates a rupture of the insulating qualities thereof.

As shown in FIG. 1, the prong-type fastener 14 is in a fully assembled condition. The fastener 14 includes a prong member 15 formed from an elongated thin strip of metal. One end of the fastener 14 is shaped into a penetrating point 16 which is further defined from the elongated strip of material 15 by a bend line 17. The opposite end of the prong is defined by a second bend line 18 so as to designate a substantially square base 19. The opposite longitudinal edges 20 and 21 of the prong between the base 19 and the penetrating point 16 are provided with a series of stepped notches 22.

Cooperating with the prong 15 is a locking plate 23. As shown in FIG. 2, locking plate 23 is formed from a square blank of material and has formed through a center line thereof a partial slot 24. This slot 24 terminates into substantially U-shaped slots 25 and 26 with the U-shaped slots 25 and 26 having their end arms extending in opposite directions equally spaced from a center line drawn through the partial center slot 24. By this construction the slot 24 of locking plate 23 cooperating with the oppositely disposed U-shaped slots 25 and 26 to provide confronting retaining wall abutments 27 and 28. The U-shaped slots 25 and 26 each define opposed latch fingers 29 and 30.

It should be noted that the width of the prong 15 between its opposite longitudinal edges 20 and 21 is greater than the length of the partial center slot 24 such that when the prong 15 is projected through the slot 24 the latching fingers 29 and 30 will yieldably give way so as to be bent out of the normal plane of the locking plate 23 as seen in FIG. 1.

In full construction the base 19 of the prong 15 is mounted on the inner face of the corrugation 11 by spot welding or the like. The prong 14 is bent along the bend line 18 so as to extend at right angles from the base 19 as well as the inner face of the corrugation 11. The batt of insulating material 12 is impinged upon the prong 15 with the point 16 thereof easily penetrating through the batt of insulating material 12 as well as the wire screening 13 until it is exposed therefrom. At this point the locking plate 23 is pressed onto the prong 15 with the point 16 thereof entering and passing through the partial center slot 24 formed in the plate 23. The retaining wall abutments 27 and 28 will prevent the prong 15 from twisting or becoming distorted out of its longitudinal plane so as not to rupture the batt of insulating material 12 during the assembly.

As the locking plate 23 is forcibly moved over the prong 15 the opposite longitudinal edges 20 and 21 of the prong will engage the inner confronting edges 31 of the locking fingers 29 and 30 causing the same to ride thereon until they snap into one of the stepped notches 22. When the plate 23 has been mounted on the prong 15 such that there is a slight compression of the batt of insulating material 12 between it and the inner face of the corrugation 11 the assembling operation is complete.

The final step is to then bend the penetrating point 16 about its bend line 17 until it is in facial abutment with the outer surface of the locking plate 23 as seen in FIG. 1.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described my invention what I claim as new and desire to protect by Letters Patent is:

1. A prong-type fastener for assembling an insulated wall panel including an outer metallic wall structure and a batt of insulating material comprising (a) an elongated substantially rectangularly-shaped body of metallic material, (b) a base member formed at one end of said body and extending transversely with respect to the longitudinal length thereof and adapted to be fixedly connected to the inner wall surface of the outer metallic wall structure, (c) a penetrating point formed on the opposite end of said body and adapted to have a batt of insulating material impinged thereon between said base and said point, (d) a locking member comprising a substantially flat square plate of a size greater than said base adapted for cooperating with said body member for maintaining the batt of insulating material upon said body between said locking member and said base and to surround the area of penetration of said penetrating point through the batt of insulating material, (e) a slot formed in said locking member through which said elongated body projects as said locking member is positioned on said body in facial abutment with said batt of insulating material surrounding the area of penetration of said point therethrough, (f) said slot terminating at opposite ends into U-shaped slots which define latching fingers extending in opposite directions toward said slot formed in said locking member with said latching fingers adapted to have contact with opposite longitudinal edges of said body as said body is projected through said slot (g) said slot and said U-shaped slots defining guide members to either side of said slot for guiding said locking member on said body with said latching fingers in contact with opposite longitudinal edges of said body, and (h) a series of step notches formed on said opposite longitudinal edges of said body between said penetrating point and said base and adapted to contact said latching fingers as said body is guided through said slot for latching said locking member on said body inwardly of said penetrating point.

* * * * *